US005637992A

United States Patent [19]

Edwards

[11] Patent Number: 5,637,992

[45] Date of Patent: Jun. 10, 1997

[54] VOLTAGE REGULATOR WITH LOAD POLE STABILIZATION

[75] Inventor: William E. Edwards, Milford, Mich.

[73] Assignee: SGS-Thomson Microelectronics, Inc., Carrollton, Tex.

[21] Appl. No.: 456,120

[22] Filed: May 31, 1995

[51] Int. Cl.[6] ..... G05F 3/16; G05F 3/20

[52] U.S. Cl. ..... 323/315; 323/280; 323/316

[58] Field of Search ..... 323/265, 280, 323/315, 316

[56] References Cited

U.S. PATENT DOCUMENTS

| | | | |
|---|---|---|---|
| 4,628,247 | 12/1986 | Rossetti | 323/314 |
| 4,943,737 | 7/1990 | Guo et al. | 323/315 |
| 5,182,525 | 1/1993 | Theus | 330/253 |
| 5,182,526 | 1/1993 | Nelson | 323/316 |
| 5,451,861 | 9/1995 | Giebel | 323/315 |
| 5,512,816 | 4/1996 | Lambert | 323/315 |
| 5,519,309 | 5/1996 | Smith | 323/316 |

*Primary Examiner*—Stuart N. Hecker
*Attorney, Agent, or Firm*—Theodore E. Galanthay; Lisa K. Jorgenson; Renee M. Larson

[57] ABSTRACT

A voltage regulator with load pole stabilization is disclosed. The voltage regulator consists of an output stage, a comparator stage, and an active load. The active load draws current from the output of the voltage regulator inversely proportional to the current demand on the voltage regulator. When the output current demand is low, the active load draws relatively low current. When the output current demand is large, the active load draws a relatively large amount of current. Consequently, the disclosed voltage regulator has high stability without consuming excess power.

15 Claims, 1 Drawing Sheet

VOLTAGE REGULATOR WITH LOAD POLE STABILIZATION

BACKGROUND OF THE INVENTION

1. Field of the Invention

This invention relates to electronic circuits used as voltage regulators and more specifically to circuits and methods used to stabilize a voltage regulator.

2. Description of the Relevant Art

The problem addressed by this invention is encountered in voltage regulation circuits. Voltage regulators are inherently medium to high gain circuits, typically 50 db or greater, with low bandwidth. With this high gain and low bandwidth, stability is often achieved by setting a dominate pole with the load capacitor. Achieving stability over a wide range of load currents with a low value load capacitor (~0.1 uF) is difficult because the load pole formed by the load capacitor and load resistor can vary by more than three decades of frequency and be as high as tens of KHz requiring the circuit to have a very broad band of greater than 3 MHz which is incompatible with the power process used for voltage regulators.

FIG. 1 shows a prior art solution to the stabilization problem. The voltage regulator 24 in FIG. 1 converts an unregulated Vdd voltage, 12 volts in this example, into a regulated voltage at node 26, 5 volts in this example. Capacitor 8, resistor 10, amplifier 12, and resistor 14 are configured as an integrator having the output voltage node 26 as an inverting input and a voltage reference as the non-inverting input. The integrator drives bipolar transistor 4 which is connected in series with an output current mirror formed by p-channel transistors 2 and 16, as is known in the art. Resistor 18 is a pull down resistor added to increase the stability of the circuit.

In this prior art example, the pole associated with the pull down resistor can be calculated as:

$$f=1/2\pi R_L C_L$$

where $R_L$=resistance of the load=R18 in parallel with R20 and $C_L$=is typically around 0.1 microfarad Therefore, the pole associated with the prior art circuit is load dependent and can vary from 16 Hz to 32 KHz for an R18 equal to 100 kilo-ohms and R20 ranging from 50 ohms to 1 mega-ohm. The wide variation of the pole frequency is difficult to stabilize, as will be appreciated by persons skilled in the art. A prior art solution to this problem is to change the pull down resistor R18 from 500 kilo-ohms to around 500 ohms which changes the pole frequency to a range of 3.2 KHz to 32 KHz, which is a frequency spread of 1 decade instead of 3 decades. However, the power dissipated by the output transistor 16 increases, as shown below:

$$\text{power}=(12\ v-5\ v)(I_{load}+I_{pull\ down})=(7\ v)(100\ mA)+(7\ v)(10\ mA)$$

Therefore, the 500 ohm resistor adds 70 milli-watts of power dissipation in the chip which is approximately a 10% increase in power dissipation for the added stability.

SUMMARY OF THE INVENTION

Therefore, it is an object of the invention to increase the stability of a voltage regulator without increasing the power dissipated in the circuit. Additionally, it is an object of the invention to have an active pull down resistor which decreases resistance when necessary to maintain stability and increases resistance to decrease power consumption. These and other objects, features, and advantages of the invention will be apparent to those skilled in the art from the following detailed description of the invention, when read with the drawings and appended claims.

The invention can be summarized as a voltage regulator with load pole stabilization. The voltage regulator consists of an output stage, a comparator stage, and an active load. The active load draws current from the output of the voltage regulator inversely proportional to the current demand on the voltage regulator. When the output current demand is large, the active load draws relatively low current. When the output current demand is low the active load draws a relatively large amount of current. Consequently, the disclosed voltage regulator has high stability without consuming excess power.

DETAILED DESCRIPTION OF THE PREFERRED EMBODIMENT

Figure 1:
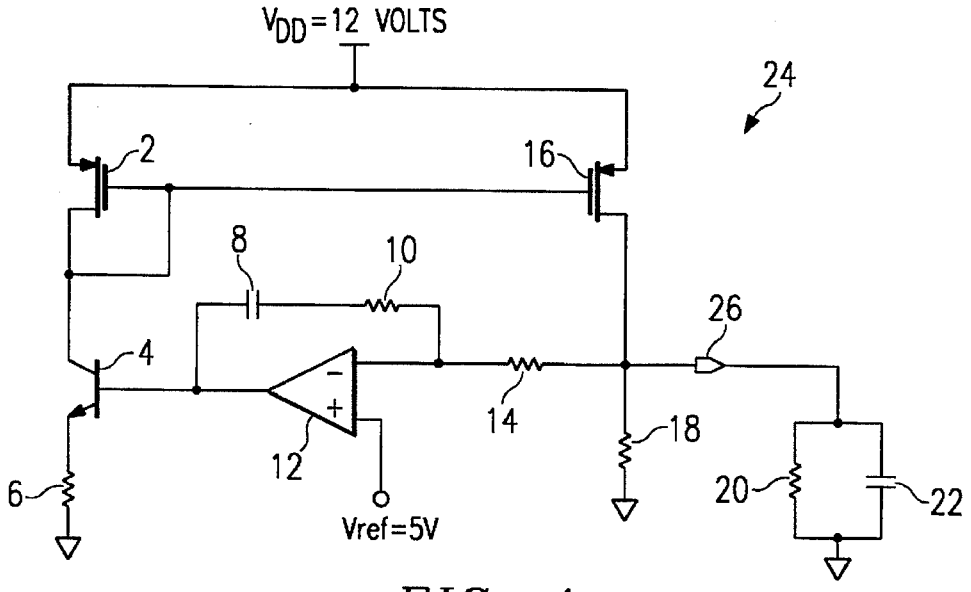
FIG. 1 (PRIOR ART)
FIG. 1 is a schematic diagram of a voltage regulator with a pull down resistor as is known in the prior art.
Figure 2:
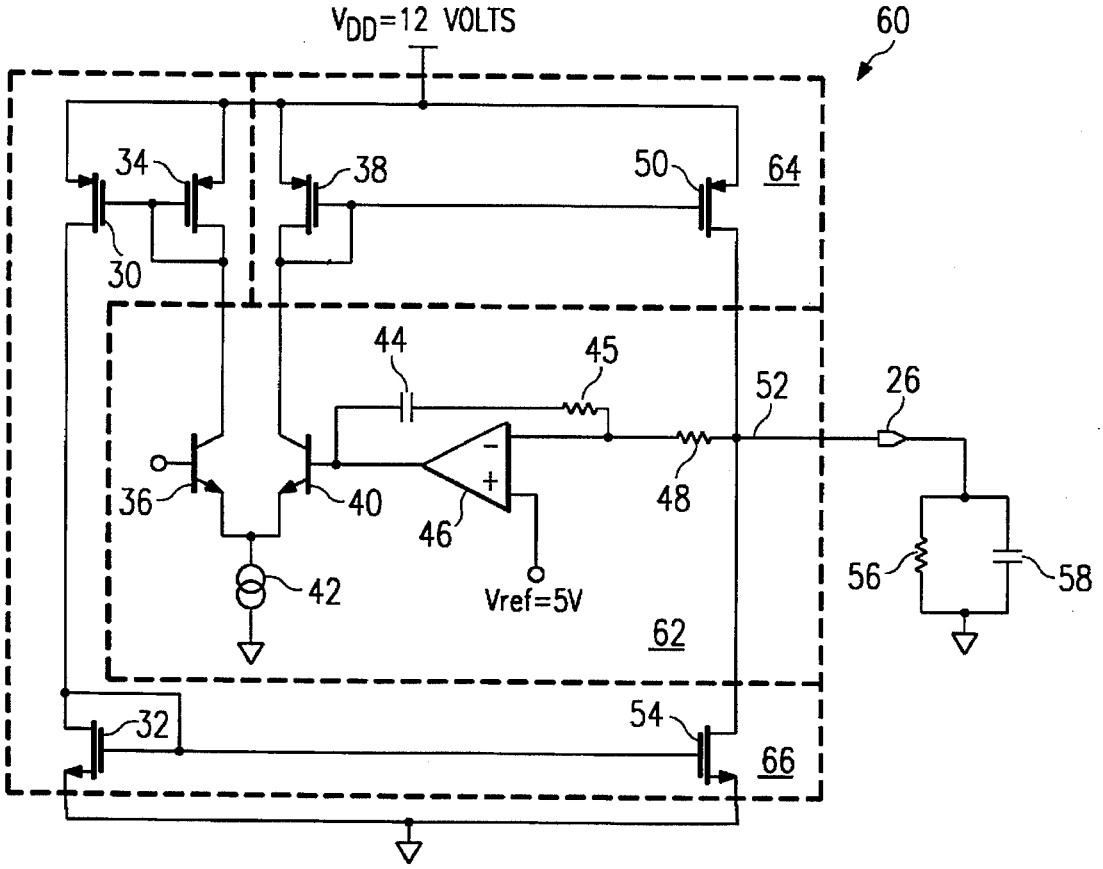
FIG. 2 is a schematic diagram of a voltage regulator with an active load.

A voltage regulator constructed according to the preferred embodiment of the invention in FIG. 2 will be described. The voltage regulator 60 comprises a comparator stage 62, an output stage 64, and an active load 66.

The comparator stage 62 is constructed by connecting a base of a NPN transistor to a first plate of capacitor 44 and to an output of an operational amplifier 46. The emitter of transistor 40 is connected an emitter of a NPN transistor 36 and to a draining end of a current source 42. The sourcing end of the current source is connected to a voltage reference, ground. The base of transistor 36 is connected to a bias voltage which is not shown. The second plate of capacitor 44 is connected to a first end of resistor 45. The second end of resistor 45 is connected to an inverting input of amplifier 46 and to the first end of resistor 48. The non-inverting input is connected to a reference voltage, which is this example is 5 volts. The regulator will track the reference voltage, as is understood in the art.

The output stage is constructed by connecting a drain and a gate of P-channel transistor 38 and a gate of a P-channel transistor 50 to the collector of transistor 40. This connection comprises the output of the comparator stage and the input of the output stage. The sources of transistors 38 and 50 are connected to a Vdd, which in this example is 12 volts. The drain of transistor 50 is connected to the second end of resistor 48 and to a drain of N-channel transistor 54. This connection forms the output of the output stage, the output of the voltage regulator, and the input of the comparator stage.

The active load 66 is constructed by connecting the collector of transistor 36 to the drain and the gate of a P-channel transistor 34 transistor and to the gate of a P-channel transistor 30. The sources of transistors 30 and 34 are connected Vdd. The drain of transistor 30 is connected to the drain and gate of N-channel transistor 32 and to the gate of an N-channel transistor 54. The sources of transistors 32 and 54 are connected to ground.

The load which is not part of the invention is shown as a resistor 56 connected in parallel with a capacitor 58.

In operation, the current mirror created by transistor 38 being connected to transistor 50 comprise the output stage.

The output stage drives current onto node 52 responsive to a comparator stage. The current flowing through transistor 50 is proportional to the current flowing through transistor 38 where the proportion is determined by the relative areas of the transistors as is known in the art. The resulting voltage on node 52 is sensed through resistor 48 and compared to the voltage reference on the non-inverting input of amplifier 46. The integrator formed by capacitor 44 and resistor 45 create the dominate pole and has a zero that cancels the load pole. The output of amplifier 46 drives transistor 40 which drives the current through the current mirror of the output stage. The current through transistor 40 is limited by the current source 42.

Transistor 36, transistor 40 and current source 42 are configured as a differential pair. Therefore, the current through transistors 36 and 40 equals the current of current source 42. As the current demand on the output stage increases, current through transistor 40 increases and current through transistor 36 decreases by a proportional amount. Conversely, as the current through transistor 40 decreases, the current through transistor 36 increases by a proportional amount.

The current through transistor 36 is mirrored through the current mirror created by transistors 30 and 34. The current through transistor 30 is mirrored by the current mirror created by transistor 32 and transistor 54. Consequently, the active load 66 current increases as the current through output stage 64 decreases; conversely, if the current through the output stage 64 increases, the current through the active load 54 decreases.

The operation of the circuit can be described quantitatively by the equations listed below:

$$I_{36}+I_{40}=I_{42} \quad 1)$$

$$I_{54}=nI_{36} \quad 2)$$

where, $$n=\left[\frac{\text{WIDTH30}}{\text{WIDTH34}}\right]\left[\frac{\text{WIDTH54}}{\text{WIDTH32}}\right]$$

$$I_{50}=mI_{40} \quad 3)$$

where, $$m=\left[\frac{\text{WIDTH50}}{\text{WIDTH38}}\right]$$

4)

$$I_{50}=I_{LOAD}+I_{54}$$

$$\therefore I_{54} = \frac{mI_{42}-I_{LOAD}}{m/n+1} \approx \frac{mI_{42}-I_{LOAD}}{m/n}$$

note: max $I_{LOAD}=mI_{42}$

5) For $I_{LOAD}=0$
$I_{54}=nI_{42}$ so, the resistance of transistor 54 is effectively:

$$\frac{V_{52}}{I_{54}}=\frac{V_{52}}{nI_{42}}$$

6) So at maximum output current,
$I_{LOAD}=mI_{42}$ and $I_{54}=0$
Thus, $R_{EFF}$=infinity Additionally, the load poles are calculated as follows: since, $$f=\frac{1}{2\pi RC}$$

where $R=R_{EFF}$ and $C=C_{22}$

7)

$$@I_{LOAD}=0$$

$$R_L=\infty$$

$$R_{EFF}=\frac{V_0}{nI_T}$$

$$f=\frac{1}{2\pi\frac{V_0}{nI_{42}}C_{58}}$$

8)

$$@I_{LOAD}=I_{max}=mI_{42}$$

$$f=\frac{1}{2\pi\frac{V_0}{mI_{42}}C_{58}}$$

$$(R_{EFF}=0)$$

9) Load pole variation is ratio of R for $I_L=0$; $I_L=I_{max}$ $$\frac{\frac{V_0}{mI_{42}}}{\frac{V_0}{nI_{42}}}=\frac{m}{n}$$

for n=m Fixed load pole 10 n=m Load pole varies~1 decade frequency

The power dissipation in transistor 16 can be calculated as follows:

10)

$$I_{50}=I_{58}+\frac{mI_{42}-I_{load}}{\frac{m}{n}}$$

$P=(V^{-V}{}_{O})(I_{m1})$ (where $(V^{+}-V_{O})=V_{DS}$) $P \propto I_{m1}$ for fixed supply $P=(V^{+}-V_0)(I_{m1})$ (where $(V^{+}-V_0)=V_{DS}$)
$P \propto I_{m1}$ for fixed supply

| $I_{LOAD}$ | $I_{50}$ | $P_{50}$ |
|---|---|---|
| 0 | $nI_{42}$ | $V_{16(DS)}nI_{42}$ |
| $.1I_{max}=.1mI_{42}$ | $.1mI_{42}+.9nI_{42}$ | $V_{16(DS)}nI_{42}$ |
| $.2I_{max}=.2mI_{42}$ | $.2mI_{42}+.8nI_{42}$ | $V_{16(DS)}nI_{42}$ |
| $.5I_{max}=.5mI_{42}$ | $.5mI_{42}+.5nI_{42}$ | $(.5mI_{42}+.5nI_{42})V_{(16)DS}$ |
| $I_{max}=mI_{42}$ | $mI_{42}$ | $(mI_T)V_{16(DS)}$ |

-continued

| $P = (V^+ - V_0)(I_{ml})$ (where $(V^+ - V_0) = V_{DS}$) $P \propto I_{ml}$ for fixed supply | | |
|---|---|---|
| $I_{LOAD}$ | $I_{50}$ | $P_{50}$ |

$I_{50} = I_{LOAD} + I_{54}$
Note: As L increases the current in transistor 50 decreases as does its contribution to power dissipation.

$$I_{50}=I_{LOAD}+I_{54}$$

Note: As $I_L$ increases the current in transistor 50 decreases as does its contribution to power dissipation.

By using an active load, the voltage regulator 60 provides the advantage of increasing the stability of voltage regulator 60 without increasing the power dissipated in the circuit. Additionally, voltage regulator 60 has an active pull down resistor which decreases in resistance when necessary to maintain stability and increases resistance to decrease power consumption when the extra load is not needed for stability.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A voltage regulator circuit having load pole stabilization, comprising:

an output stage having an input and having an output;

a comparator stage for driving the output stage responsive to comparing the output of the output stage to a voltage reference, the comparator stage having a first input connected to the output of the output stage, having a second input connected to a voltage reference, and having an output connected to the input of the output stage;

an active load having an input connected to the input of the output stage and having a conductive path from the output of the output stage to a reference voltage, wherein the conductive path increases conductivity inversely proportional to a voltage at the output of the comparator stage.

2. The voltage regulator circuit of claim 1 wherein the conductive path of the active load comprises a transistor.

3. The voltage regulator of claim 2 wherein the transistor comprises a n-channel MOSFET transistor.

4. The voltage regulator of claim 1 wherein the active load comprises a first current mirror for sensing a current flowing through the output stage and a second current mirror having an input for sensing the first current mirror and having an output, wherein the output is the conductive path of the active load.

5. A method for stabilizing a voltage in a voltage regulator having an output stage comprising the steps of:

loading the output voltage with an active load, sensing a current proportional to an output current, increasing the loading as the output current decreases, and decreasing the loading as the output current increases.

6. The method of claim 5 wherein the loading is performed by a transistor.

7. The method of claim 6 wherein the transistor is a n-channel MOSFET.

8. A voltage regulator circuit having load pole stabilization, comprising:

a means for generating an output voltage having an input and having an output;

a means for comparing the output voltage to a voltage reference, the means for comparing having a first input connected to the output voltage, having a second input connected to a voltage reference, and having an output connected to the input of the means for generating an output voltage, and a means for generating an active load having an input connected to the input of the means for generating an output voltage and having a conductive path connected across the output voltage to a reference voltage, wherein the conductive path increases conductivity inversely proportional to a voltage at the output of the means for comparing the output voltage.

9. The voltage regulator circuit of claim 8 wherein the conductive path of the means for generating an active load comprises a transistor.

10. The voltage regulator of claim 9 wherein the transistor comprises a n-channel MOSFET transistor.

11. The voltage regulator of claim 8 wherein the means for generating an active load comprises a first current mirror for sensing a current flowing through the means for an output voltage and a second current mirror having an input for sensing the first current mirror and having an output, wherein the output is the conductive path of the active load.

12. A power supply system having at least one voltage regulator having load pole stabilization wherein the voltage regulator comprises:

an output stage having an input and having an output;

a comparator stage for driving the output stage responsive to comparing the output of the output stage to a voltage reference, the comparator stage having a first input connected to the output of the output stage, having a second input connected to a voltage reference, and having an output connected to the input of the output stage, and an active load having an input connected to the input of the output stage and having a conductive path from the output of the output stage to a reference voltages, wherein the conductive path increases conductivity inversely proportional to a voltage at the output of the comparator stage.

13. The power supply of claim 12 wherein the conductive path of the active load comprises a transistor.

14. The power supply of claim 13 wherein the transistor comprises a n-channel MOSFET transistor.

15. The power supply of claim 12 wherein the active load comprises a first current mirror for sensing a current flowing through the output stage and a second current mirror having an input for sensing the first current mirror and having an output, wherein the output is the conductive path of the active load.

* * * * *